United States Patent [19]

Kulik et al.

[11] 4,283,806

[45] Aug. 18, 1981

[54] SHOE MACHINE AIR BLAST MECHANISM AND AIR BLAST SAFETY DEVICE

[75] Inventors: Alphonse C. Kulik, Ipswich, Mass.; Josef J. Walter, Johnson City, N.Y.

[73] Assignee: USM Corporation, Farmington, Conn.

[21] Appl. No.: 47,829

[22] Filed: Jun. 12, 1979

[51] Int. Cl.[3] ..... A43D 9/00; A43D 21/00; A43D 23/00

[52] U.S. Cl. ..... 12/142 R; 12/10.1; 12/10.5; 118/411; 118/707;

[58] Field of Search ..... 12/142 R, 10.1, 10.5; 118/411, 707; 222/56

[56] References Cited

U.S. PATENT DOCUMENTS

| | | | |
|---|---|---|---|
| 2,579,967 | 12/1951 | Ruau | 118/707 X |
| 3,056,337 | 10/1962 | Bahr et al. | 118/707 X |
| 3,972,303 | 8/1976 | Klantke et al. | 118/411 X |

FOREIGN PATENT DOCUMENTS

| | | | |
|---|---|---|---|
| 2447488 | 4/1975 | Fed. Rep. of Germany | 118/411 |

*Primary Examiner*—James Kee Chi
*Attorney, Agent, or Firm*—Donald N. Halgren

[57] ABSTRACT

A device for cement applying mechanisms in shoe lasting machines, wherein a safety valve is caused to prevent air from entering an air feed line in the cement feed when there is no shoe in the shoe machine and the shoe machine has been actuated, thereby preventing the machine operator from being injured by hot cement, and where nozzles may be effectively used with an air blast to controllably project hot cement onto portions of insoles some of which may not be immediately thereadjacent.

7 Claims, 4 Drawing Figures

SHOE MACHINE AIR BLAST MECHANISM AND AIR BLAST SAFETY DEVICE

BACKGROUND OF THE INVENTION (1) Field of the Invention

This invention relates to shoe machines, and more particularly to an air blast mechanism and a safety mechanism to prevent hot cement from being undesirably ejected from an insole nozzle.

(2) Prior Art

The dispensing of hot thermoplastic adhesive, or cement in a controlled manner is necessary for safe, efficient, injury free shoe manufacture. The cement is discharged generally through a U-shaped nozzle arrangement disposed about the periphery of an insole support plate on a shoe lasting machine. The nozzle has an array of orifii that permits the ejecting of the hot cement onto the bottom surface of an insole held thereadjacent. The nozzles may eject cement onto flat lasted shoe bottoms onto welt-type shoe bottoms, or high heel shoes, depending upon the type of shoe being lasted. Problems arise when the cement is inadvertently sprayed onto the upper which is to be lasted to the insole, or when any cement fails to reach the portion of the insole heelward of the ball break in a toe and ball lasting operation. Of greater concern is the possibility of hot cement being sprayed on a lasting machine operator when a shoe is not disposed on the insole support plate, and when the operative mechanism which causes the cement ejection from the nozzle is accidentally activated. Neither of the above concerns appear to be considered by the prior art, however, certain shoe machine mechanisms may be exemplified as in the nozzle art by U.S. Pat. Nos. 3,943,885; 3,570,454; 3,906,569; and 3,422,797. Prior art which embody devices for melting and/or dispensing molten cement as shown in U.S. Pat. Nos. 3,239,103 and 3,318,481.

It is an object of the present invention, to provide a shoe lasting machine with a cement dispensing apparatus that can be controlled to prevent unintentional hot cement ejection when there is no shoe to be lasted on the machine.

It is a further object of the present invention to provide a nozzle that will prevent cement from being inadvertently sprayed on the inside of the uppers prior to lasting thereof.

It is yet another object of the present invention to provide a nozzle that will permit the ejection of cement to portions of an insole that are not in very close contact with the nozzle.

BRIEF SUMMARY OF THE INVENTION

The present invention provides a shoe lasting machine with a "no-shoe" cement shut-off arrangement where a pincer which is normally used in pulling an upper about a last, may cause an air supply valve in the cement feed line to be shut off when the pincer has no upper in its jaws. The valve, after being shut-off prevents further air pressure from being supplied to the cement feed line, where it thereby prevents the hot cement from being ejected from the nozzle. The nozzle is arranged to provide a shield along its outer periphery and its ejection orifii are countersunk to provide cavities which permit the collection of a bubble of cement to form therein during pressurization of the cement feed line to permit the controlled bubbling of cement against the insole. The nozzles also have a throat portion which permits air blast controlled ejection of cement therefrom, to portions of an insole not immediately adjacent the nozzle.

BRIEF DESCRIPTION OF THE DRAWINGS

The objects and advantages of the invention will become more apparent when viewed in conjunction with the following drawings, in which.

DESCRIPTION OF THE PREFERRED EMBODIMENT

Figure 1:
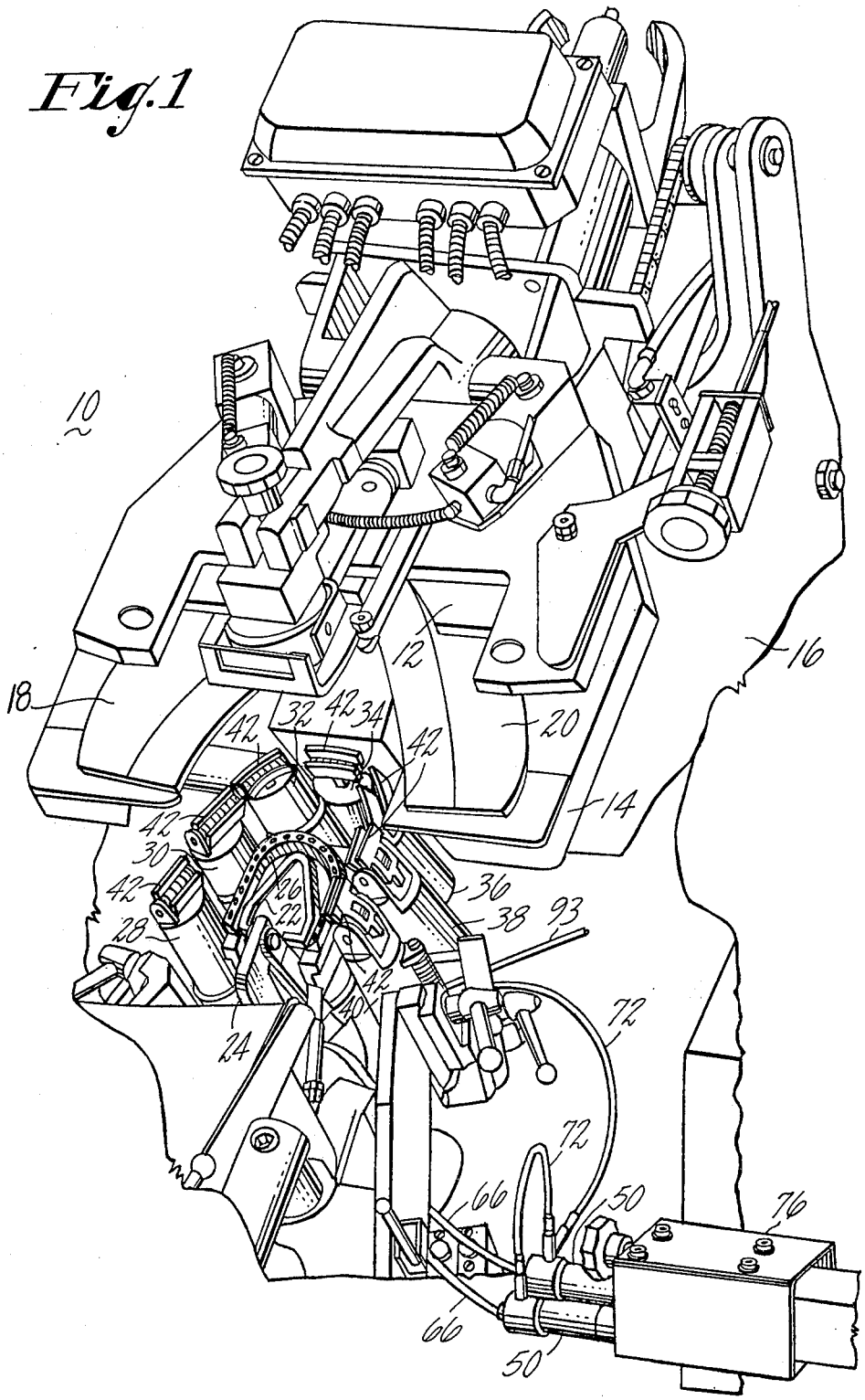
FIG. 1 is a partial perspective view of a shoe lasting machine constructed according to the principles of the present invention.

Referring now to the drawings in detail, and particularly to FIG. 1, there is shown a shoe lasting machine 10, suitable for pulling and lasting a shoe upper in the toe and forepart regions of a shoe.

The shoe lasting machine 10 comprises a reciprocatable head 12 movably mounted on a lower support member 14 which is secured to a portion of a frame 16 of the machine. The reciprocable head 12 includes a pair of wipers 18 and 20 which move downward and inwardly to wipe an upper, not shown in FIG. 1, against a last and an insole, also not shown. The last and its attendant insole would be disposed on an insole support plate 22, held by a support arm 24. A U-shaped nozzle 26 is movably arranged adjacent the periphery of the insole support plate 22. The nozzle 26 may apply a supply of hot cement to the bottom periphery of an insole held on the insole support plate 22, just prior to lasting thereof. The nozzle 26 has means to permit it to move up and down in relation to the support plate 22 and toward and away from any insole thereon. A plurality of pincers, 28,30,32,34,36,38, and 40, are shown each with a pair of jaws 42 in a U-shaped arrangement adjacent the periphery of the nozzle 26. The pincers, are used to pull an upper securely and tightly about a last, while at the same time the nozzle 26 is caused to move upwardly by drive system means, not shown, and to eject the hot cement on an insole.

Figure 2:
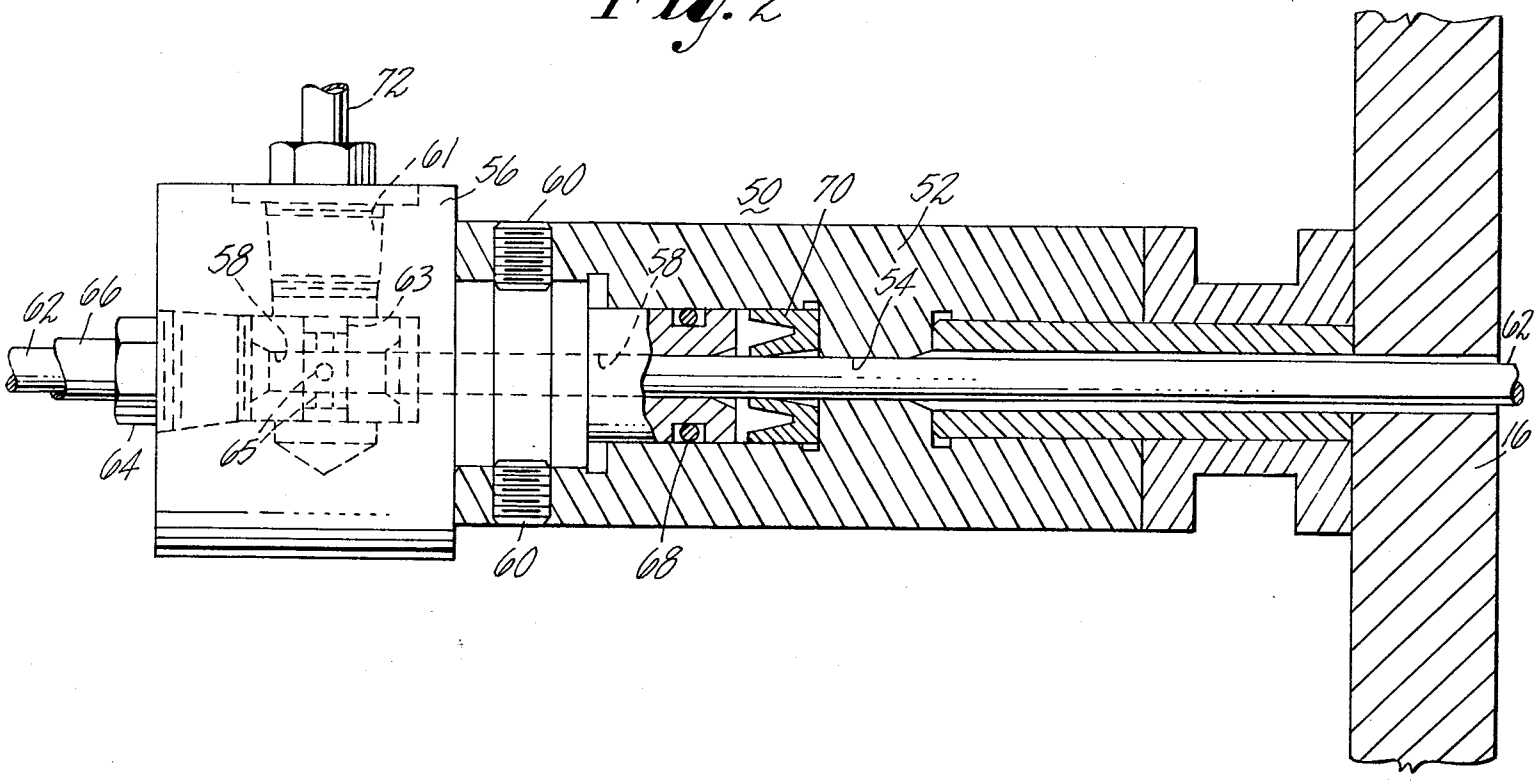
FIG. 2 is a side elevational view of a cement feed system for the shoe lasting machine.

A pair of air blast cylinders 50 are shown in FIG. 1, and a partial side elevational view of an airblast cylinder 50 is also shown in FIG. 2. Each air blast cylinder 50 comprises a casing 52 having a longitudinal bore 54 extending therethrough. An annular fitting 56, is secured to one end of the casing 52, and has a longitudinal bore 58 coaxial with the longitudinal bore 54 in the casing 52. The annular fitting 56 may be secured to the casing 52 by attachment means such as set-screws 60, or the like. The annular fitting 56 has a pressurized fluid inlet orifice 61 and an exit orifice 64. The exit orifice 64 is coaxial with the bore 58 and is in fluid communication with the inlet orifice 61. The exit orifice 64 has an annular relief 63 formed therearound, with a plurality of passageways 65 providing fluid communication between the inlet orifice 61 and the bore 58. A cement rod 62 extends through the bores 54 and 58. The cement rod 62, which may be unwound from a spool, not shown, is caused to discharge through the exit orifice 64 and also through a feed tube 66. An O-ring 68 is disposed on a channel near one end of the annular fitting 56 to provide a seal between it and the casing 52. An annular exclusion ring 70 made from urethane or the like, is snugly arranged about the cement rod 62 to provide a seal between the cement rod 62 and the inner surface of the casing 52. A pressurizable fluid supply tube 72, shown in FIG. 2, is attached to the inlet orifice 61 to permit a controllable pressurizable fluid to be provided thereto. The air blast cylinders 50 are secured to a portion of the frame 16 in conjunction with a cement rod feed regulation device 76.

Figure 3:
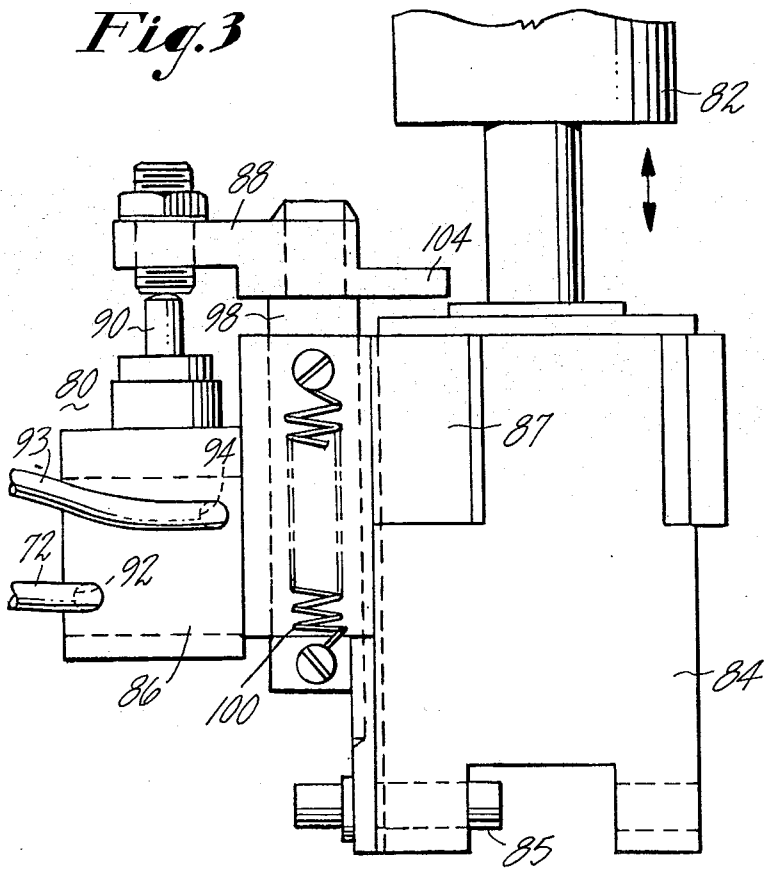
FIG. 3 is a side view of a safety valve.

A "no-shoe" valve 80, shown in FIG. 3, is disposed near the base of one of the pincers, preferably the lower right hand pincer 40. The pincer 40 may have an upper pneumatic cylinder 82 which upon activation through a proper circuit, controls the gripping motion of the jaws 42. The pincer 40 may have a second lower pneumatic cylinder 84, or other motion causing device, which through activation of a proper circuit, provides the pulling forces and up and down motion thereto. The second lower cylinder 84 has a connection means 85 whereby it may be pivotally connected to the frame 16 of the machine 10. The valve 80 has a main body portion 86 which may be held by a bracket 87 to the lower cylinder 84. The valve 80 also has a trip lever 88 having a first shaft 90 secured at one end. The first shaft 90 reciprocably extends into the main body portion 86 of the valve 80, providing through standard internal means, a pressurized fluid shut-off and release means between a pressurizable fluid inlet 94 and a pressurizable fluid outlet 92 in the body portion 86 of the valve 80. The pressurizable fluid inlet 94 receives the pressurized fluid through a conduit 93 from the regulatable pressurized fluid source, not shown. The trip lever 88 has a second shaft 98 having one end portion secured near the other end of the lever 88, the distal end of the second shaft 98 having a biasing means such as a spring or the like 100 attached therefrom to the bracket 87. The trip lever 88 has a lip portion 104 which extends beyond the second shaft 98.

Figure 4:
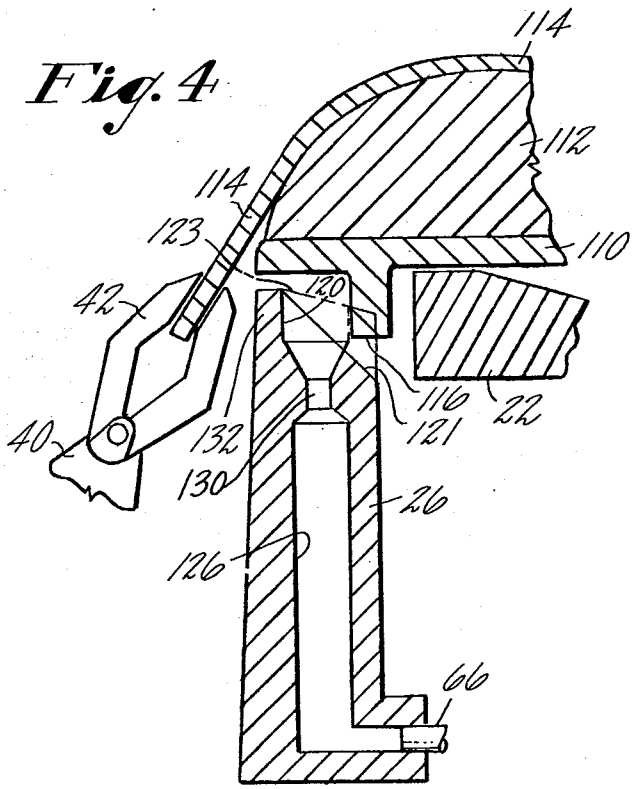
FIG. 4 is a side elevational view of a cement nozzle constructed in accordance with the principles of the present invention, including an elevational view of a shoe to be lasted therewith.

The nozzle 26, shown in cross-section in FIG. 4, is situated beneath an insole 110, a last 112 and an upper 114 thereon, not shown in the other figures for clarity. The insole 110 in this particular embodiment is a welt-type having a downstanding rib 116 thereon. Other insoles might not have any downstanding rib. The nozzle 26 is preferably of generally U-shaped, as may be seen in FIG. 1, and it has a plurality of outlet orifii 120. The nozzle 120 may have a skewed upper surface 121, to provide a camming means for bending the ribs 116 inwardly and providing a volume for cement to bubble into, or they may have a generally horizontal upper surface 123, indicated by dashed lines, for performing cement application on flat lasting work. Each outlet orifice 120 with either nozzle surface, may have a reservoir 126, which in this embodiment is of cylindrical shape. One end of the reservoir 126 is in fluid communication with the cement feed tube 66, which is shown in FIG. 2. The feed tubes 66, pass through a heating unit, not shown, which heats the cement rod 62, to melt it and turn it into a fluid at a temperature of about 240° to 260° C. The other end of the reservoir 126 is in fluid communication with a throat or metering hole 130, which is a channel of reduced diameter, that connects the reservoir 126 with the outlet orifice 120. The nozzle 26 may have an outer U-shaped peripheral edge which defines a shield 132. Each outlet orifice 120 has a countersunk cross-sectional area which is about 6 times the area of the metering hole 130. The orifii 120 are countersunk to provide a space for the molten cement to collect and bubble.

In operating the shoe lasting machine 10 with an air blast mechanism and an air blast safety mechanism, the cement rods 62 are each passed through the feed regulation device 76 which governs the quantity of cement rod 62 passing therethrough. From there the cement rods 62 each pass through one of the air blast cylinders 50. Pressurized fluid, in this embodiment—air, is caused to be fed into the cylinders 50 from the supply tubes 72, which has been shunted through a safety device, to be explained below, and which safety device receives the pressurized fluid from a standard regulatable pressure fluid source, not shown. The pressurized air is prevented from backing out the bore 54 in the casing 52 by the exclusion ring 70 in close contact with the cement rod 62 and the inner surface of the casing 52. The pressurized air then passes out the feed tubes 66, shown in FIGS. 1 and 2, together with the cement rod 62, and is directed through the heating unit, not shown, and from there, each feed tube 66 is directed to a particular portion of the nozzle 26. The feed tubes 66 may each be directed to a half-side of the nozzle 26, or one tube 66 may be directed to the toeward end which may need cement "bubbled" thereto. The other tube 66 may be directed to the heelward orifii of the nozzle 26 which may need cement ejected therefrom to reach an insole surface spaced slightly therefrom, as may be the case with high heel shoes having a bottom contour spaced away from the nozzle 26, that is, the point of the insole heelward of the break of the ball.

When any insole 110, in this instance, a welted type, an upper 114 and a last 112 are on the insole support plate 22, as shown in FIG. 4, the lasting operation is ready to commence. The hot molten cement may be controllably air blasted from the heating unit, through the feed lines 66, to the reservoirs 126 in the nozzle 26. The hot cement may be forced through the metering hole 130 to give it a velocity to be jetted from the orifii 120 to reach the "spaced away" insole, or it may be slowly pressurized to permit the cement to bubble up in the countersunk outlet orifice 120 and bubble against portions of the insole. The shield 132 would prevent any hot cement from being inadvertently sprayed onto the underside of the upper 114, the upper 114 being held under tension by the jaws 42 of the pincers 28,30,32,34,36,38, and 40.

In the absence of an upper and an insole on a last disposed on the insole support plate, as is shown in FIG. 1, no cement should be blown out of the metering holes 130 which may potentially injure the shoe lasting machine operator if the machines' 10 mechanism were inadvertently activated. With no-shoe disposed on the insole support plate 22, the jaws 42 of the pincers, and the lower right side pincer 40 in particular, would not have any upper 114 therewith to tension. This would cause the lower pneumatic cylinder 84 in the pincer 40, which would otherwise just provide tension to the upper 114, to withdraw the entire pincer 40 and jaws 42 to their retractedmost position. That would cause lower edge of the cylinder 82 to strike and move the lip portion 104 of the trip lever 88, forcing the shaft 90 into main body portion 86 of the "non-shoe" valve 80 to shut-off the pressurized air blast line between the supply tube 72 of the cylinders 50 and the controllable pressure fluid supply, not shown. Once the fluid pressure is shut-off, the hot cement is no longer forced through its respective supply lines 66 to the reservoirs 126 in the nozzles 26, and no hot cement may be ejected therefrom. When there is an upper held in the jaws 42 of the pincer 40, the biasing means 100 keeps the "no-shoe" valve 80 open, and the machine 10 may operate normally.

Thus there has been shown an air blast hot cement mechanism and an air blast hot cement safety mechanism where a shoe machine is capable of cementing various contour insoles in an efficient manner and is also rendered harmless against accidental activation to insure the safety of the operator of the machine.

It is intended that the appended claims are to be interpreted as exemplary only, and not in a limiting sense.

We claim:

1. A machine for lasting shoes in which the margin of a shoe upper is secured to the bottom of an insole by cement applied along the margin of the forepart of the insole bottom including:

a nozzle engageable generally along at least portions of the bottom margin of said insole, for applying molten cement to said insole;

a cement feed apparatus for supplying molten cement to said nozzle; and a safety apparatus for preventing any molten cement from being discharged from said nozzle when an insole and an upper are absent nozzle, said safety apparatus comprising a reciprocably movable pincer having a set of jaws with which to grab and tension said upper, and which senses any absence of an insole and upper therewith to effect the shutting off said cement feed apparatus.

2. A machine for lasting shoes as recited in claim 1, wherein said cement feed apparatus includes a pressurizable fluid system which feeds pressurizable fluid into a cement supply line for forcing said molten cement through said nozzle.

3. A machine for lasting shoes as recited in claim 2, wherein said cement supply line includes at least one cylinder which receives a quantity of cement into an intake therein and which receives pressurizable fluid through a first conduit to an intake therein, and discharges them in a conduit to direct said cement and pressurized fluid to said nozzle.

4. A machine for lasting shoes as recited in claim 3, wherein said safety apparatus also includes said first conduit for supplying pressurized fluid to said cylinder wherein a pressure shut-off valve activated by said reciprocably movable pincer prevents pressurized fluid from proceeding further in said first conduit to said cylinder in the absence of an insole and upper on said nozzle.

5. A machine for lasting shoes as recited in claim 4, where said pressure shut-off valve is adapted to be closed by said pincer during retraction thereof when said pincer fails to tension an upper within its jaws, because of its absence therebetween.

6. A machine for lasting shoes as recited in claim 5, wherein said valve is biased so as to open when said pincer is raised therefrom and is tensioning an upper with its jaws.

7. A method of preventing a shoe machine operator from being inadvertently sprayed with molten cement from a nozzle of a shoe machine during the absence of any shoe to be lasted on said nozzle, wherein said nozzle has molten cement therein which is normally supplied with pressurized fluid from a pressurized fluid supply line, said method comprising:

gripping a set of jaws together on a pincer;

retracting said jaws of said pincer so as to tension an upper registered therebetween;

withdrawing said pincer to a retractedmost position in the absence of an upper which would otherwise maintain the position of the pincer and upper relative thereto; and activating a shut-off valve in said pressurized fluid supply line by the interaction of said retracted pincer striking a trip mechanism on said valve to shut down any pressurized fluid supplied to said nozzle, thereby preventing molten cement from being ejected therefrom.

* * * * *

UNITED STATES PATENT OFFICE

CERTIFICATE OF CORRECTION

Patent No. 4,283,806 Dated August 18, 1981

Inventor(s) Alphonse C. Kulik and Josef J. Walter

It is certified that error appears in the above-identified patent and that said Letters Patent are hereby corrected as shown below:

Claim 1; Line 28 - After "absent" insert "from said".

" Line 33 - After "off" insert "of".

Signed and Sealed this

Ninth Day of March 1982

[SEAL]

Attest:

GERALD J. MOSSINGHOFF

Attesting Officer

Commissioner of Patents and Trademarks